US007522147B2

(12) United States Patent
Lin et al.

(10) Patent No.: US 7,522,147 B2
(45) Date of Patent: Apr. 21, 2009

(54) SOURCE DRIVER AND DATA SWITCHING CIRCUIT THEREOF

(75) Inventors: Che-Li Lin, Taipei (TW); Chang-San Chen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 636 days.

(21) Appl. No.: 11/162,651

(22) Filed: Sep. 18, 2005

(65) Prior Publication Data

US 2007/0013638 A1 Jan. 18, 2007

(30) Foreign Application Priority Data

Jul. 12, 2005 (TW) ..... 94123509 A

(51) Int. Cl.
*G09G 3/36* (2006.01)

(52) U.S. Cl. ..... 345/100; 345/98

(58) Field of Classification Search ..... 345/42, 345/48, 54–55, 87–89, 92–96, 98–100, 211
See application file for complete search history.

(56) References Cited

U.S. PATENT DOCUMENTS

2003/0151584 A1* 8/2003 Song et al. ..... 345/100
2003/0197668 A1* 10/2003 Song et al. ..... 345/87
2003/0197672 A1* 10/2003 Yun et al. ..... 345/99
2003/0197815 A1* 10/2003 Choi et al. ..... 349/43
2004/0125067 A1* 7/2004 Kim et al. ..... 345/98
2005/0200585 A1* 9/2005 Igarashi et al. ..... 345/93

* cited by examiner

*Primary Examiner*—Amare Mengistu
*Assistant Examiner*—Hong Zhou
(74) *Attorney, Agent, or Firm*—Jianq Chyun IP Office

(57) ABSTRACT

A data switching circuit is provided. The circuit includes a control unit and a switching unit. The control unit provides a switching signal. The switching unit has N input ends and (N+1) output ends. The switching unit receives the switching signal. If N is an integer number and $1 \leqq i \leqq N$, the switching unit turns on both the connection between the i-th input end and the i-th output end and the connection between a dummy data and the (N+1) output end as the switching signal takes a first status. The switching unit turns on both the connection between another set of dummy data and the first output end and the connection between the i-th input end and the (i+1)-th output end as the switching signal takes a second status.

18 Claims, 7 Drawing Sheets

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |

Frame T

| | | | | | |
|---|---|---|---|---|---|
| − | + | − | + | − | + |
| + | − | + | − | + | − |
| − | + | − | + | − | + |
| + | − | + | − | + | − |
| − | + | − | + | − | + |

Frame T+1

SOURCE DRIVER AND DATA SWITCHING CIRCUIT THEREOF

CROSS-REFERENCE TO RELATED APPLICATION

This application claims the priority benefit of Taiwan application Ser. No. 94123509, filed on Jul. 12, 2005. All disclosure of the Taiwan application is incorporated herein by reference.

BACKGROUND OF THE INVENTION

1. Field of Invention

The present invention relates to a source driver and a data switching circuit thereof, and particularly to a source driver and a data switching circuit thereof suitable for dot-inversion driving mode.

2. Description of the Related Art

A source driver is an important module in a TFT LCD (thin film transistor liquid crystal display). The source driver is in charge of transferring digital data signals for displaying frames into analog signals, which are then output to every sub-pixel, or called a dot.

FIG. 1 is a schematic structural block diagram of a conventional source driver 100. A source driver 100 receives a data signal 110 and outputs the analog signal through N pieces output channels $Y_1$~$Y_N$. The source driver 100 includes a shift register 101, a line latch 102, a level shifter 103, a digital-to-analog converter (DAC) 104 and an output buffer 105. The regular source driver is a conventional technology, and structure or the function thereof should be well known by those skilled in the art. In brief, the shift register 101 is used for allocating the data signal 110 to the output channels $Y_1$~$Y_N$, the line latch 102 temporarily stores the data signal and the level shifter 103 amplifies the data signal. Further, the digital-to-analog converter (DAC) 104 transfers the data signal into an analog signal. Finally, the output buffer 105 outputs the analog signal.

In a TFT LCD, liquid crystal is used as the material for controlling display. To avoid liquid crystal polarization, an AC (alternating current) voltage is applied for driving the voltage, not DC (direct current). Therefore, there are various inversion driving modes, such as column-inversion mode, line-inversion mode and dot-inversion mode, and so on. FIG. 2 is a diagram showing the dot-inversion driving mode. Wherein, the sub-pixels driving polarities of a TFT LCD for a frame T and the next frame T+1 are shown, and + indicates a positive polarity driving mode, while – indicates a negative polarity driving mode. It can be seen from FIG. 2 that the so-called dot-inversion means any two adjacent pixels on a frame in either horizontal direction or vertical direction, have opposite driving polarity, respectively; further, on the next frame, all pixels alter the driving polarity thereof.

The dot-inversion driving mode has a lot of advantages. However, the biggest disadvantage of the dot-inversion driving mode is the large power consumption. FIG. 3 is a diagram showing signal waves of a conventional dot-inversion driving mode, wherein a source driver 301, through an output buffer 302 and data tines DL0~DL3, outputs analog signals to sub-pixels SP0~SP3 located on a same scan line SL in a pixel array 303. The panel of a modern large-screen TFT LCD is mostly designed to use a DC common voltage Vcom; thus, there are a positive-polarity voltage higher than the common voltage Vcom and a negative-polarity voltage lower than the common voltage Vcom. In FIG. 3 for example, the voltage polarity output from the data line DL0 and DL2 is, in sequence, positive, negative and positive; while the voltage polarity output from the data line DL1 and DL3 is, in sequence, negative, positive and negative. Every time when entering a next scan line or a next frame, the voltage polarity of the data lines DL0~DL3 must be inverted. Therefore, the source driver 301 should provide an applied voltage Vswing of around two times as large as the common voltage Vcom. With a larger applied voltage Vswing, more power consumption is required. In addition, to meet the trend of larger screen, higher resolution and wide viewing technology, for example, in-plane switching (IPS) or multi-domain vertical alignment (MVA), a higher driving voltage is essentially needed, which complicates the above-described problem.

SUMMARY OF THE INVENTION

An object of the present invention is to provide a data switching circuit suitable for a dot-inversion driving mode for reducing the applied voltage output from the source driver and consequently reducing power consumption.

Another object of the present invention is to provide a source driver suitable for a dot-inversion driving mode, with which the output channels thereof only output a positive-polarity voltage or a negative-polarity voltage to reduce power consumption.

To achieve the above-mentioned objects or the others, the present invention provides a data switching circuit, which includes a control unit and a switching unit. The control unit provides a switching signal, which includes a first status and a second status. Whenever a frame or a scan line of a TFT LCD starts, the status of switching signal would be altered. The switching unit has N input ends and N+1 output ends. The switching unit receives the switching signal. As the switching signal takes the first status, the switching unit would turn on the connection between the i-th input end and the i-th output end and turn on the connection between a dummy data and the (N+1)-th output end, wherein N is a positive integer number and $1 \leqq i \leqq N$. As the switching signal takes the second status, the switching unit would turn on the connection between another set of dummy data and the first output end and turn on the connection between the i-th input end and the (i+1)-th output end.

In the above-described data switching circuit of an embodiment, the input end of the switching unit is coupled to a line latch of the source driver, while the output end of the switching unit is coupled to a level shifter of the same source driver.

On the other hand, the present invention further provides a source driver, which includes a line latch, a control unit, a switching unit and a digital-to-analog converter (DAC). The control unit provides a switching signal, which includes a first status and a second status. Whenever a frame or a scan line of a TFT LCD starts, the status of the switching signal would be altered. The switching unit has N input ends and N+1 output ends and the above-mentioned input ends are coupled to the line latch. As the switching signal takes the first status, the switching unit would turn on the connection between the i-th input end and the i-th output end and turn on the connection between a dummy data and the (N+1)-th output end, wherein N is a positive integer number and $1 \leqq i \leqq N$. As the switching signal takes the second status, the switching unit would turn on the connection between another set of dummy data and the first output end and turn on the connection between the i-th input end and the (i+1)-th output end. The DAC is coupled to the output end of the switching unit.

According to the embodiment of the present invention, a specially designed data switching circuit of the present invention enables the data signals to be repeatedly connected and disconnected between any two adjacent output channels. Further, a unique pixel array enables the switched data signals to be delivered to desired sub-pixels. With a dot-inversion driving mode, during a frame period, an output channel would continuously output a positive-polarity voltage or a negative-polarity voltage without repeatedly switching the output channel with positive polarity and negative polarity, so that the applied voltage output from the source driver is reduced, thus reducing power consumption.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

Figure 4:
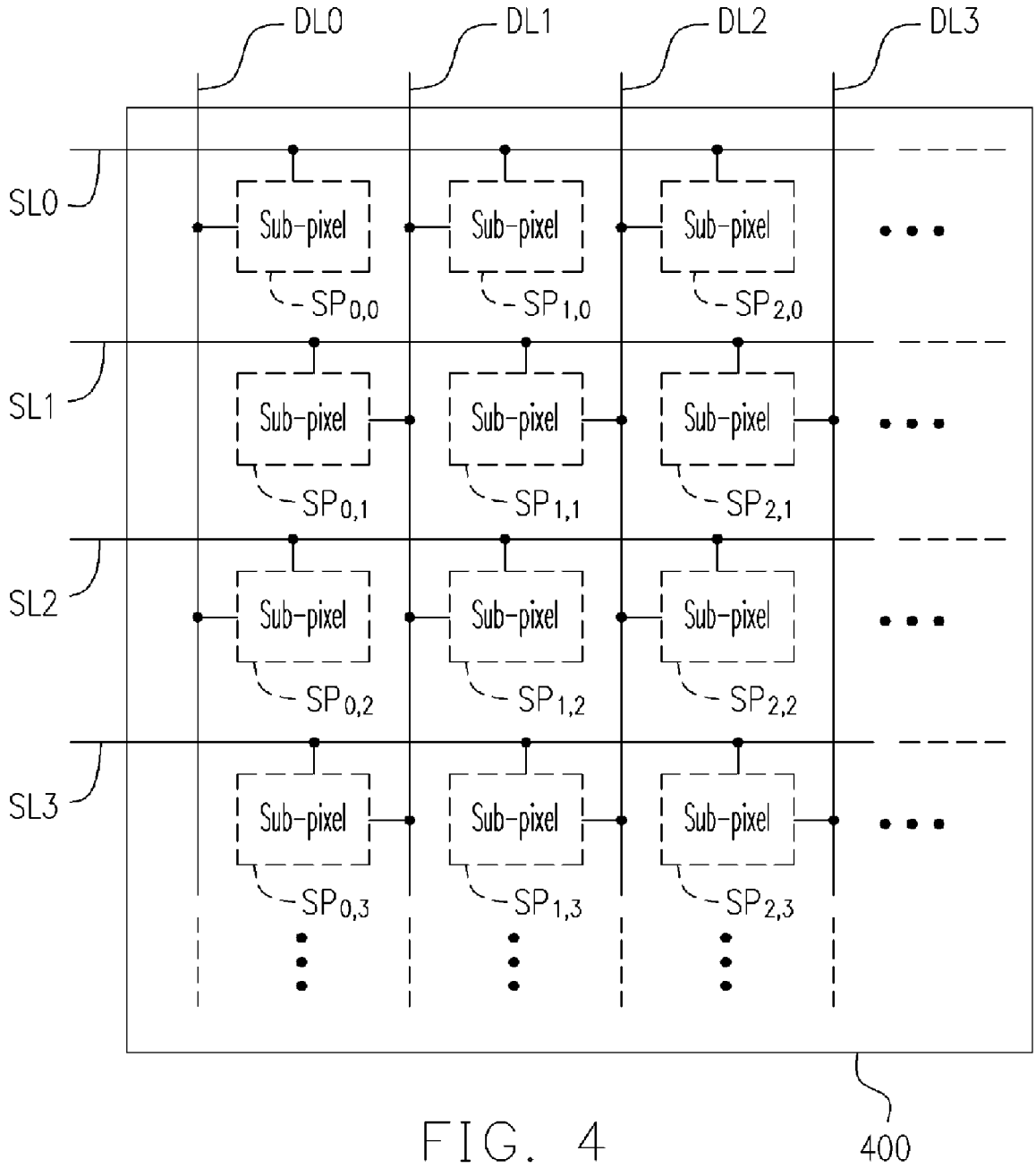
FIG. 4 is a schematic diagram showing a pixel array used in an embodiment of the present invention.

As the above described, the present invention provides a specially designed data switching circuit accompanied with a unique pixel array. FIG. 4 is a schematic diagram showing a part of pixel array 400 used in an embodiment of the present invention. The part of pixel array 400 includes data lines DL0~DL3, scan lines SL0~SL3 and 12 sub-pixels. Wherein, the first row of sub-pixels $SP_{0,0}$~$SP_{2,0}$ are coupled to the corresponding scan line SL0 above and the data lines DL0~DL2 on the left respectively; the second row of sub-pixels $SP_{0,1}$~$SP_{2,1}$ are coupled to the corresponding scan line SL1 above and the data lines DL1~DL3 on the right respectively; the third row of sub-pixels $SP_{0,2}$~$SP_{2,2}$ are coupled to the corresponding scan line SL2 above and the data lines DL0~DL2 on the left respectively; the fourth row of sub-pixels $SP_{0,3}$~$SP_{2,3}$ are coupled to the corresponding scan line SL3 above and the data lines DL1~DL3 on the right respectively. In short, for any sub-pixel $SP_{x,y}$ in the pixel array 400, if y is an even number, $SP_{x,y}$ is coupled to the data line DL(x) and the scan line SL(y); if y is an odd number, $SP_{x,y}$ is coupled to the data line DL(x+1) and the scan line SL(y).

Figure 1:
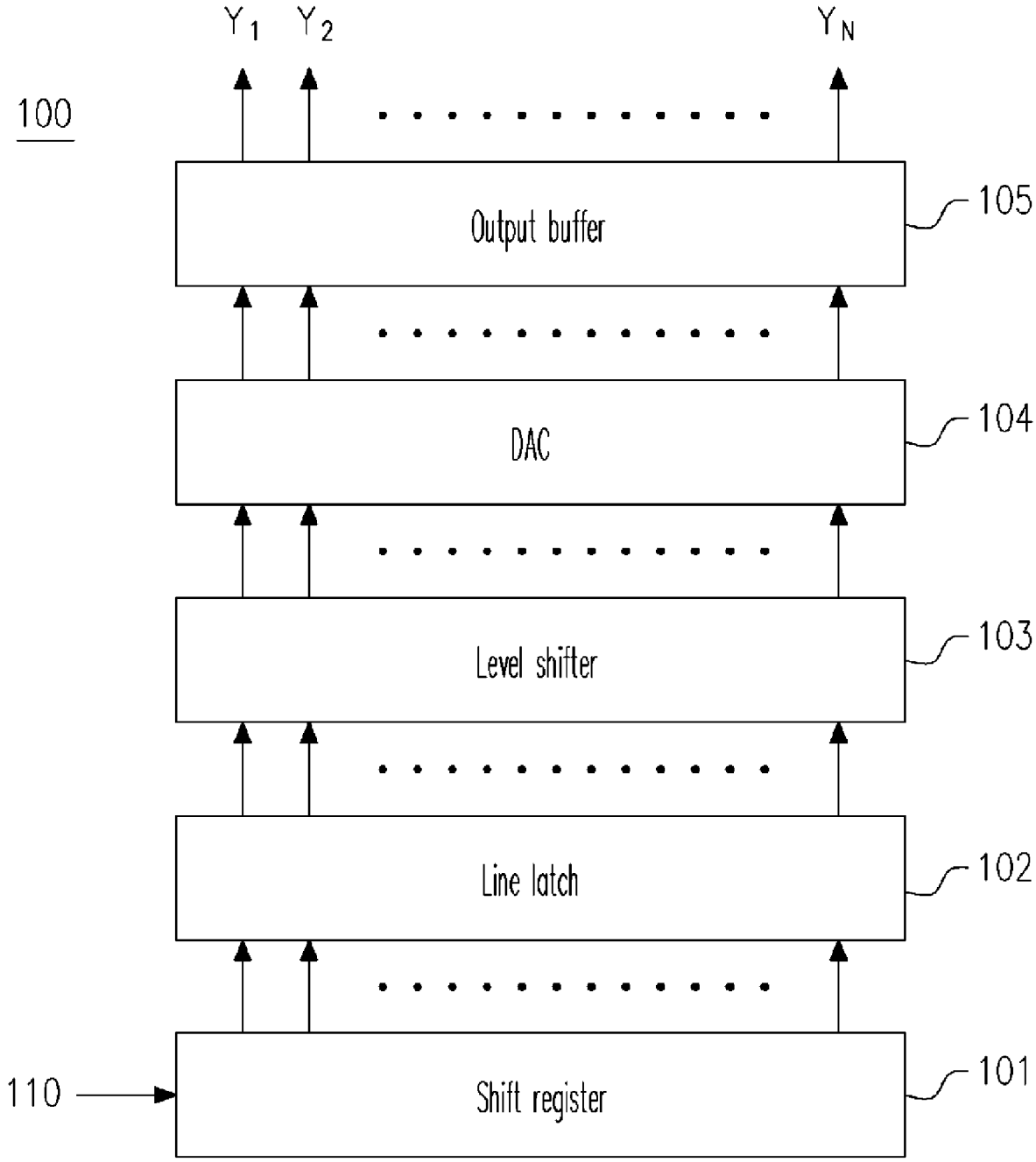
FIG. 1 (PRIOR ART)
FIG. 1 is a schematic structural block diagram of a conventional source driver.
Figures 2, 3:
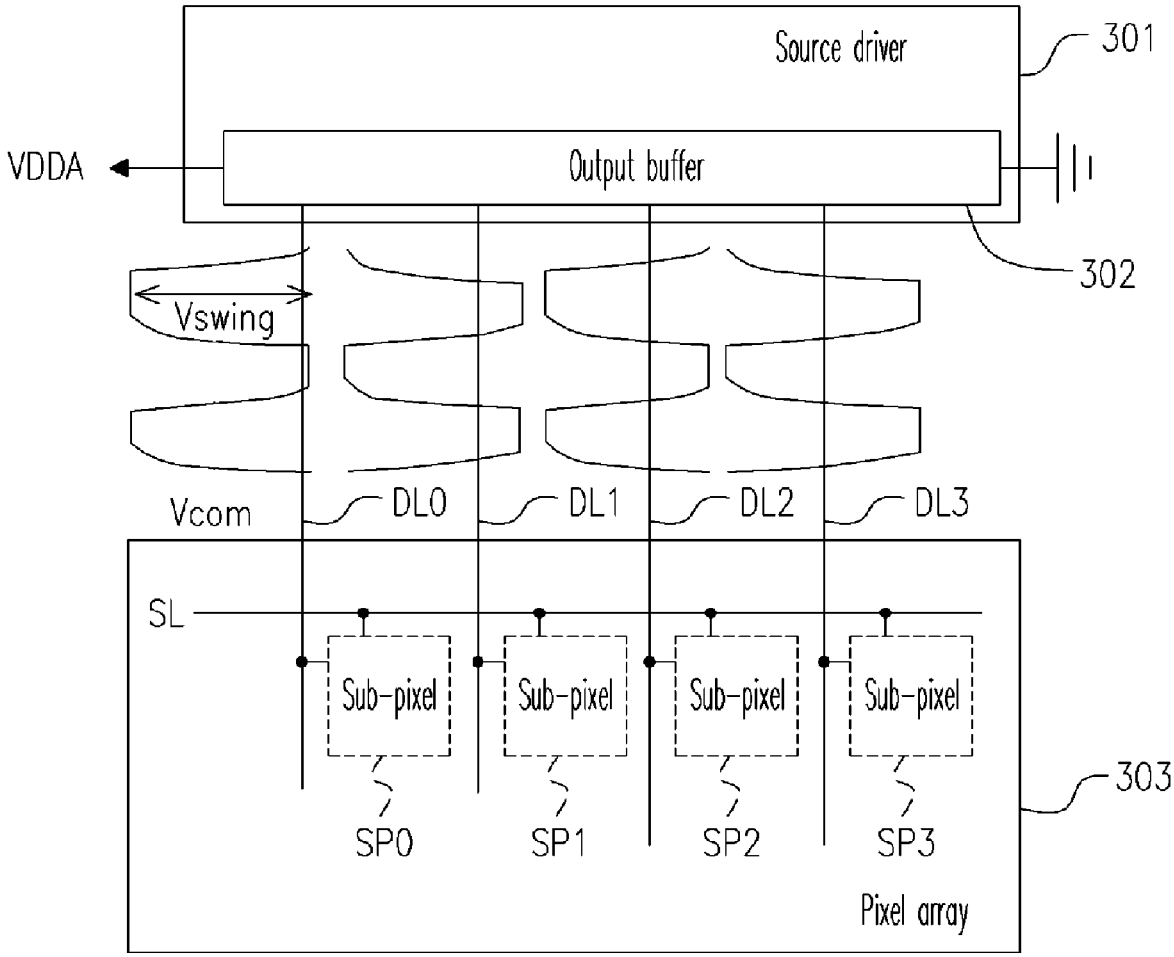
FIG. 3 (PRIOR ART)
FIG. 2 is a diagram showing dot-inversion driving mode.
FIG. 3 is a diagram showing signal waves of a conventional dot-inversion driving mode.
Figure 5:
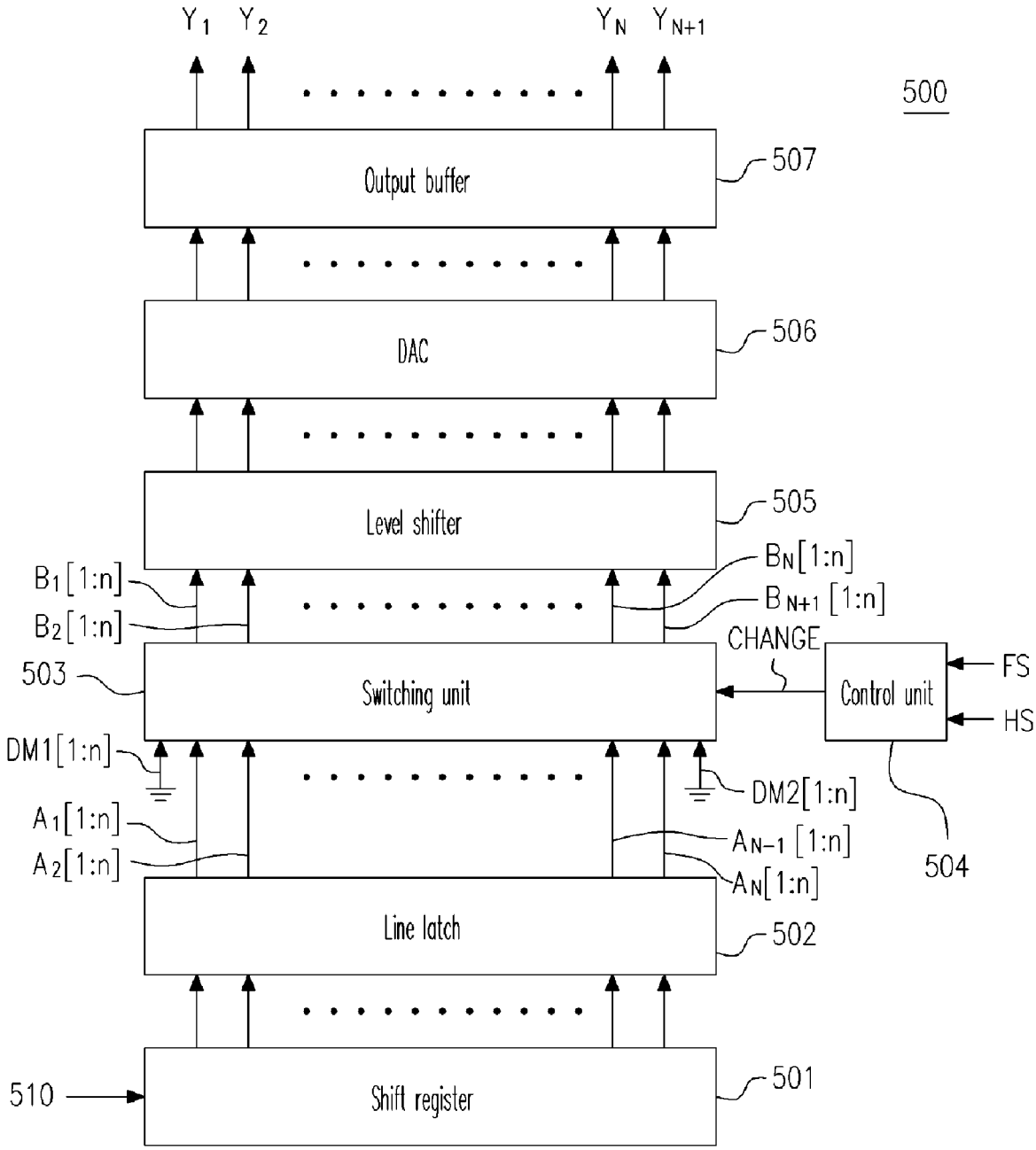
FIG. 5 is a schematic structural block diagram of a source driver according to an embodiment of the present invention.

FIG. 5 is a schematic structural block diagram of a source driver 500 according to an embodiment of the present invention. Referring to FIG. 5, the source driver 500 includes a shift register 501 for receiving data signal 510, a line latch 502 coupled to the shift register 501, a control unit 504 for producing a switching signal CHANGE, a switching unit 503 for receiving the switching signal CHANGE, a level shifter 505 coupled to the output ends of the switching unit 503, a digital-to-analog converter (DAC) 506 coupled to the level shifter 505 and an output buffer coupled to the digital-to-analog converter (DAC) 506. The data switching circuit of the embodiment includes the switching unit 503 and the control unit 504. Unless specified otherwise, the functions of other modules in FIG. 5 are the same as those in FIG. 1.

Figure 6:
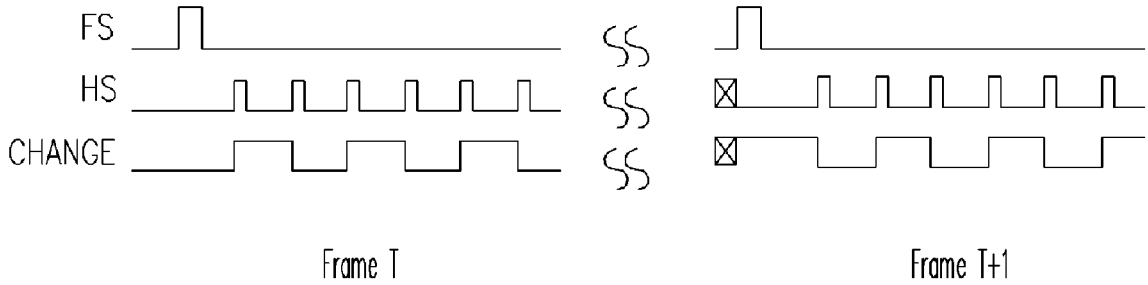
FIG. 6 is a signal-timing chart of the control unit in FIG. 5.

In the embodiment, the control unit 504 receives a frame start signal FS and a scan line start signal HS and produces the switching signal according to the signals FS and HS, as shown in FIG. 6. The frame start signal FS is synchronized with the beginning of each frame of the TFT LCD, while the scan line start signal HS is synchronized with the beginning of each scan line of the TFT LCD. Whenever a frame starts or a scan line starts, the switching signal CHANGE would alter its status so as to alter the driving polarity of sub-pixels. There are several signals in a TFT LCD available for the control unit 504. For example, a vertical synchronization signal or a start pulse signal originally provided to a gate driver can be used as a frame start signal FS by the control unit 504, while a horizontal synchronization signal or a latch data signal originally provided to the source driver can be used as a scan line start signal HS by the control unit 504.

In the embodiment, each row of the pixel array 400 has N sub-pixels and (N+1) data lines. The gray scale of each sub-pixel has an n-bit resolution, wherein both N and n are positive integers. Therefore, the source driver 500 has (N+1) output channels $Y_1$~$Y_{N+1}$, the switching unit 503 has N input signals $A_1$~$A_N$ and (N+1) output signals $B_1$~$B_{N+1}$. Wherein, both the N input signals $A_1$~$A_N$ and (N+1) output signals $B_1$~$B_{N+1}$ are n-bit digital signals. The switching unit 503 further receives two sets of n-bit dummy data DM1[1:n] and DM2[1:n] with a function to be explained hereinafter. The switching unit 503 would change the connection between the output signals $B_1$~$B_{N+1}$ and the input signals $A_1$~$A_N$, and details are shown in FIG. 7.

Figure 7:
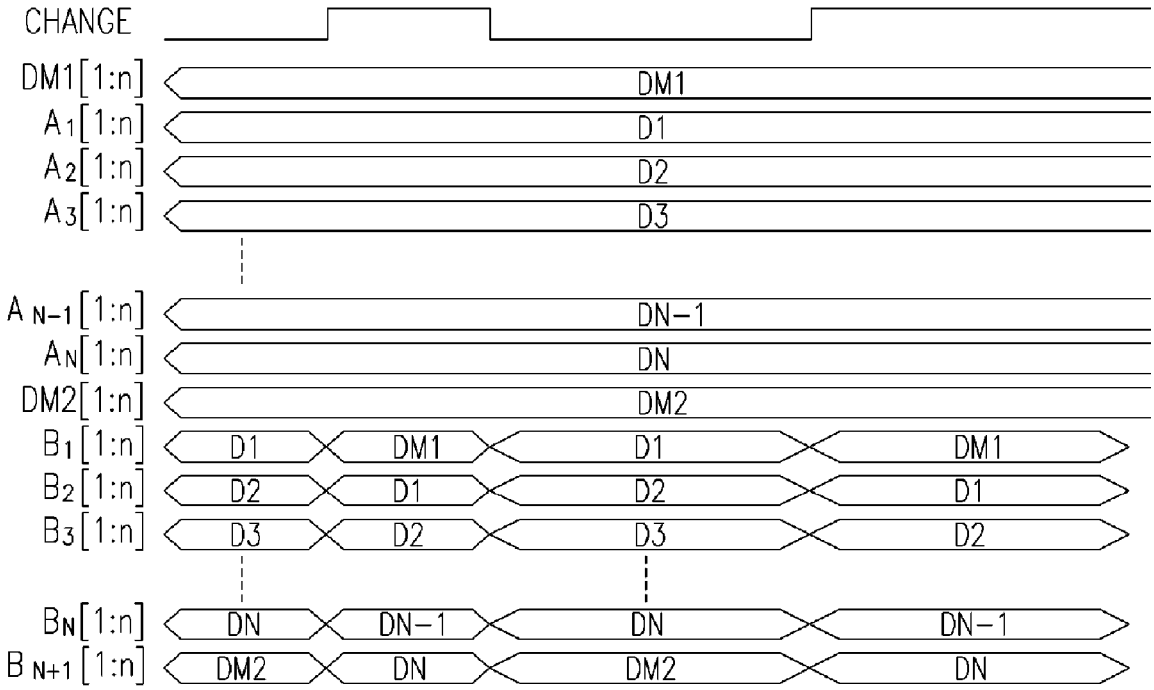
FIG. 7 is a signal-timing chart of the switching unit in FIG. 5.

FIG. 7 is a signal-timing chart of the switching unit 503 in FIG. 5. Referring to FIG. 7, the switching signal includes two statuses, i.e. logic low-level and logic high-level. If the switching signal CHANGE takes logic low-level, the switching unit 503 would take $A_i$ as $B_i$ for output and takes the dummy data DM2 as $B_{N+1}$ for output, wherein i is a positive integer number and $1 \leqq i \leqq N$. On the other hand, if the switching signal CHANGE takes logic high-level, the switching unit 503 would take the dummy data DM1 as $B_{N1}$ for output and takes $A_i$ as $B_i$ for output. All these are so-called back-and-forth switching operations.

In FIG. 5, the input end of the switching unit 503 is coupled to the line latch 502, while the output end is coupled to the level shifter 505. However, the connection can be switched and the same switching result remains; that is, the input end of the switching unit 503 can be coupled to the level shifter 505, while the output end can be coupled to the digital-to-analog converter (DAC) 506.

Figure 8:
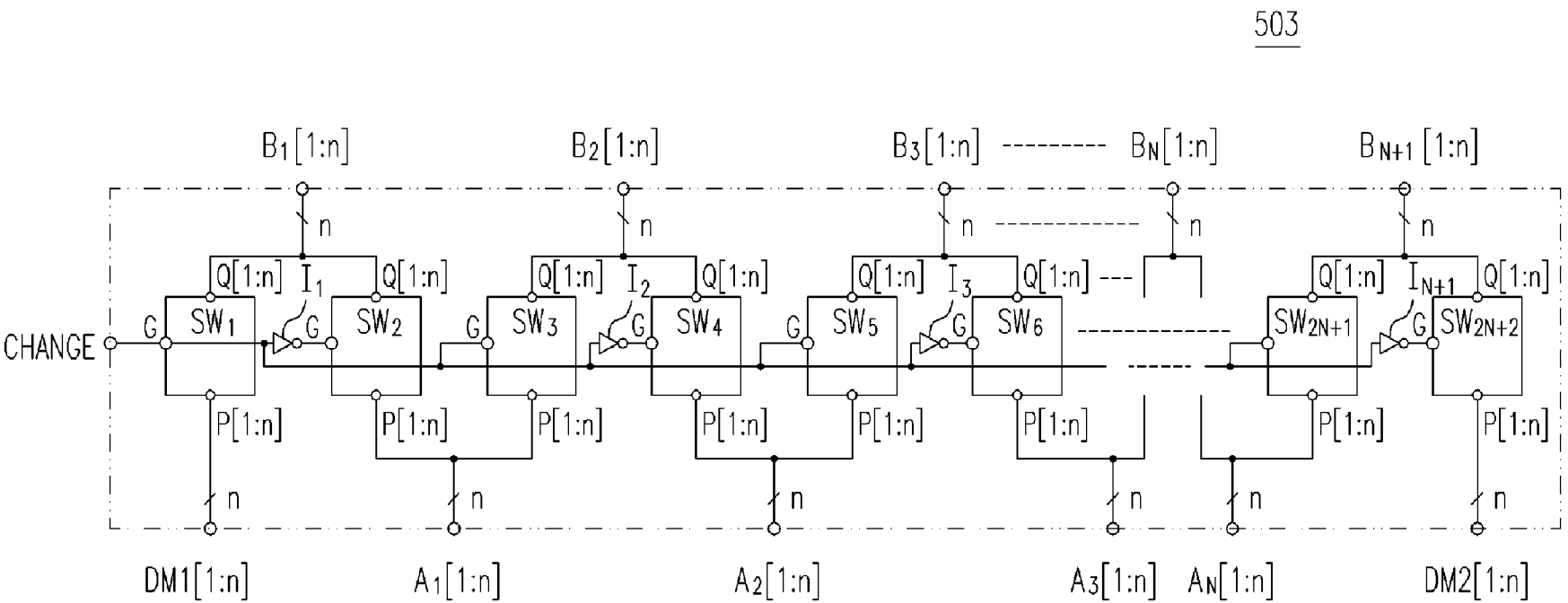
FIG. 8 is a schematic circuit drawing of the switching unit in FIG. 5.

Referring to FIG. 8, a schematic circuit drawing of the switching unit 503 in FIG. 5 is shown. In the embodiment, the switching unit 503 has N input ends receiving the input signals $A_1$~$A_N$ in total, respectively and (N+1) output ends providing the output signals $B_1$~$B_{N+1}$ in total, respectively. The switching unit 503 includes (N+1) inverters $I_1$~$I_{N+1}$ and (2N+2) switch modules $SW_1$~$SW_{2N+2}$. Wherein, each of the inverters $I_1$~$I_{N+1}$ receives the switching signal CHANGE and output an inverted switching signal, wherein i is a positive integer number and $1 \leqq i \leqq N$. The connection relationship and the functions of the switch modules are described as follows.

The operation end G of the switch module $SW_1$ is coupled to the switching signal CHANGE. The switch module $SW_1$ turns off the connection between the dummy data DM1 and the first output end of the switching unit 503 as the switching signal CHANGE takes logic low-level; while the switch module $SW_1$ turns on the connection between the dummy data DM1 and the first output end of the switching unit 503 as the switching signal CHANGE takes logic high-level.

The operation end G of the switch modules $SW_{2i}$ is coupled to the inversed switching signal output from the inverter $I_i$. The switch modules $SW_{2i}$ turns off the connection between the i-th input end and the i-th output end of the switching unit 503 as the inverted switching signal takes logic low-level, i.e. the switching signal CHANGE takes logic high-level; while the switch modules $SW_{2i}$ turns on the connection between the i-th input end and the i-th output end of the switching unit 503 as the inverted switching signal takes logic high-level, i.e. the switching signal CHANGE takes logic low-level.

The operation end G of the switch modules $SW_{2i+1}$ is coupled to the switching signal CHANGE. The switch modules $SW_{2i+1}$ turns off the connection between the i-th input end and the (i+1)-th output end of the switching unit 503 as the switching signal CHANGE takes logic low-level; while the switch modules $SW_{2i+1}$ turns on the connection between the i-th input end and the (i+1)-th output end of the switching unit 503 as the switching signal CHANGE takes logic high-level.

Finally, the operation end G of the switch module $SW_{2N+2}$ is coupled to the inversed switching signal output from the inverter $I_{N+1}$. The switch module $SW_{2N+2}$ turns off the connection between the dummy data DM2 and the (N+1)-th output end of the switching unit 503 as the inverted switching signal takes logic low-level, i.e. the switching signal CHANGE takes logic high-level; while the switch module $SW_{2N+2}$ turns on the connection between the dummy data DM2 and the (N+1)-th output end of the switching unit 503 as the inverted switching signal takes logic high-level, i.e. the switching signal CHANGE takes logic low-level.

From FIG. 8 it can be seen that the switching unit 503 is able to achieve the back-and-forth switching operations, as shown in FIG. 7. The dummy data DM1 and DM2 are mainly for avoiding a floating state of the input ends of the switch modules $SW_1$ and $SW_{2N+2}$. In the embodiment, the dummy data DM1 and DM2 are grounded, as shown in FIG. 5. In fact, the contents of the dummy data DM1 and DM2 are not critical, as long as they are within a normal operation range of the switch modules $SW_1$ and $SW_{2N+2}$.

Note that the present invention is not limited to the above-described control scheme shown in FIG. 8 that the operation end G of the switch modules $SW_1$ and $SW_{2N+2}$ is off as the input end thereof takes logic low-level, while the operation end G of the switch modules $SW_1$ and $SW_{2N+2}$ is on as the input end thereof takes logic high-level. In other embodiments, the operation can be opposite, i.e., the operation end G of the switch modules is off as the input end thereof takes logic high-level, while the operation end G of the switch modules is on as the input end thereof takes logic low-level. In addition, the circuit of the switching unit 503 in FIG. 8 is only exemplary. Any circuit of a switching unit capable of realizing the above-described back-and-forth switching mode still falls within the scope or spirit of the invention.

In the embodiment, the switch modules $SW_1$~$SW_{2N+2}$ have the same structure. Take the switch module $SW_1$ as an example, referring to FIG. 9, a schematic circuit drawing of the switch module $SW_1$ in FIG. 8 is shown. The switch module $SW_1$ has an operation end G, an n-bit input end P[1:n] and an n-bit output end Q[1:n]. If the input end P[1:n] and the output end Q[1:n] are outspread one bit by one bit, they become n pieces of input ends $P_1$~$P_n$ and n pieces of output ends $Q_1$~$Q_n$. The $SW_1$ includes n pieces of switch devices. In the embodiment, the above-described switch devices are MOSFET (metal oxide semiconductor field effect transistor).

Figure 9:
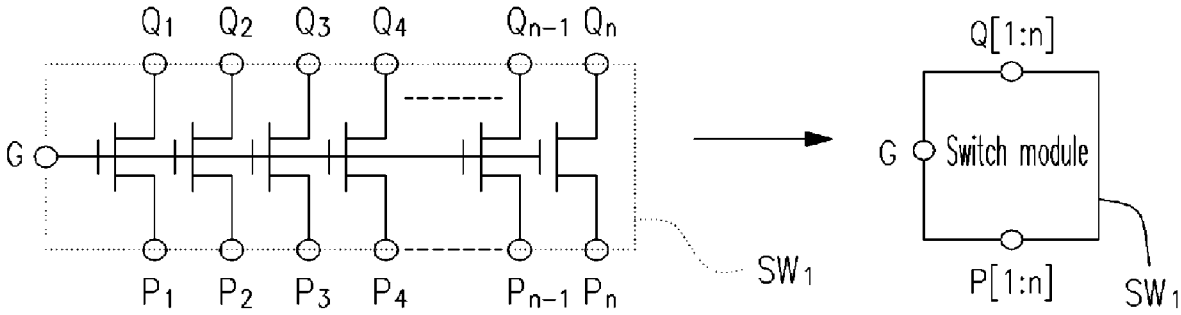
FIG. 9 is a schematic circuit drawing of the switch module in FIG. 8.

As shown in FIG. 9, the operation ends G are connected to all the gates of all the MOSFET. If k is an integer number and $1 \leqq k \leqq n$, the k-th MOSFET among the n pieces of the MOSFET would turn on or turn off the connection between the input end $P_k$ and the output end $Q_k$ according to the input status of the operation end G.

It can be seen from the above description, the present invention uses a specially designed data switching circuit to enable the data signals to conduct back-and-forth switching operations between any two adjacent output channels of the source driver and uses a unique pixel array to enable the switched data signals to be delivered to the desired sub-pixels. With the dot-inversion driving mode, during a frame period, an output channel would continuously output a positive-polarity voltage or a negative-polarity voltage without repeatedly switching the output channel with positive polarity and negative polarity, so that the applied voltage output from the source driver is reduced, thus lowering power consumption.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A data switching circuit, comprising:

a control unit, providing a switching signal, wherein the switching signal comprises a first status and a second status, and whenever a frame or a scan line of a TFT LCD starts, the switching signal alters the status; and a switching unit, having N input ends and N+1 output ends, wherein N is a positive integer number and the switching unit comprises:

(N+1) inverters. receiving the switching signal respectively and outputting an inverted switching signal: and (2N+2) switch modules, wherein if i is a positive integer number and $1 \leqq i \leqq N$, an operation end of the first switch module is coupled to the switching signal, the first switch module turns off the connection between a first dummy data and the first output end of the switching unit as the switching signal takes the first status and turns on the connection between the first dummy data and the first output end of the switching unit as the switching signal takes the second status;

an operation end of the 2i-th switch module is coupled to the inverted switching signal output from the i-th inverter, the 2i-th switch module turns off the connection between the i-th input end and the i-th output end of the switching unit as the inverted switching signal takes the first status and turns on the connection between the i-th input end and the i-th output end of the switching unit as the inverted switching signal takes the second status;

an operation end of the (2i+1)-th switch module is coupled to the switching signal, the (2i+1)-th switch module turns off the connection between the i-th input end and the (i+1)-th output end of the switching unit as the switching signal takes the first status and turns on the connection between the i-th input end and the (i+1)-th output end of the switching unit as the switching signal takes the second status;

an operation end of the (2N+2)-th switch module is coupled to the inverted switching signal output from the (N+1)-th inverter. the (2N+2)-th switch module turns off the connection between a second dummy data and the (N+1)-th output end of the switching unit as the inverted switching signal takes the first status and turns on the connection between the second dummy data and the (N+1)-th output end of the switching unit as the inverted switching signal takes the second status.

2. The data switching circuit as recited in claim 1, wherein the control unit receives a frame start signal and a scan line start signal, the frame start signal is synchronized with the beginning of each frame of the TFT LCD, the scan line start signal is synchronized with the beginning of each scan line of the TET LCD, and the switching signal is produced according to the frame start signal and the scan line start signal.

3. The data switching circuit as recited in claim 1, wherein each input end of the switching unit receives an n-bit signal, respectively; each output end of the switching unit outputs an n-bit signal, respectively; each of the switch modules comprises n pieces of switch devices, wherein the k-th switch device turns on or turns off the connection between the k-th bit of the input end and the k-th bit of the output end corresponding to the switch device according to the input status of the operation end, wherein n is a positive integer number and $1 \leqq k \leqq n$.

4. The data switching circuit as recited in claim 3, wherein the switch devices are MOSFETs.

5. The data switching circuit as recited in claim 1, wherein the input end of the switching unit is coupled to a line latch of a source driver and the output end of the switching unit is coupled to a level shifter of the source driver.

6. The data switching circuit as recited in claim 1, wherein the input end of the switching unit is coupled to a level shifter of a source driver and the output end of the switching unit is coupled to a digital-to-analog converter (DAC) of the source driver.

7. The data switching circuit as recited in claim 1, wherein the first status is logic low-level, while the second status is logic high-level.

8. The data switching circuit as recited in claim 1, wherein the first status is logic high-level, while the second status is logic low-level.

9. A source driver, comprising: a line latch;

a control unit, providing a switching signal, wherein the switching signal comprises a first status and a second status, and whenever a frame or a scan line of a TFT LCD starts, the switching signal alters the status;

a switching unit, having N input ends and N+1 output ends, wherein the input ends are coupled to the line latch and N is a positive integer number; and a digital-to-analog converter (DAC), coupled to the output ends of the switching unit;

wherein the switching unit comprises: (N+1 ) inverters, receiving the switching signal respectively and outputting an inverted switching signaL and (2N+2) switch modules, wherein if i is a positive integer number and $1=i \leqq N$, an operation end of the first switch module is coupled to the switching signal, the first switch module turns off the connection between a first dummy data and the first output end of the switching unit as the switching signal takes the first status and turns on the connection between the first dummy data and the first output end of the switching unit as the switching signal takes the second status;

an operation end of the 2i-th switch module is coupled to the inverted switching signal output from the i-th inverter. the 2i-th switch module turns off the connection between the i-th input end and the i-th output end of the switching unit as the inverted switching signal takes the first status and turns on the connection between the i-th input end and the i-th output end of the switching unit as the inverted switching signal takes the second status;

an operation end of the (2i+1)-th switch module is coupled to the switching signal, the (2i+1)-th switch module turns off the connection between the i-th input end and the (i+1)-th output end of the switching unit as the switching signal takes the first status and turns on the connection between the i-th input end and the (i+1)-th output end of the switching unit as the switching signal takes the second status;

an operation end of the (2N+2)-th switch module is coupled to the inverted switching signal output from the (N+1)-th inverter. the (2N+2)-th switch module turns off the connection between a second dummy data and the (N+1)-th output end of the switching unit as the inverted switching signal takes the first status and turns on the connection between the second dummy data and the (N+1)-th output end of the switching unit as the inverted switching signal takes the second status.

10. The source driver as recited in claim 9, wherein the control unit receives a frame start signal and a scan line start signal, the frame start signal is synchronized with the beginning of each frame of the TET LCD, the scan line start signal is synchronized with the beginning of each scan line of the TFT LCD, and the switching signal is produced according to the frame start signal and the scan line start signal.

11. The source driver as recited in claim 9 wherein each input end of the switching unit receives an n-bit signal, respectively; each output end of the switching unit outputs an n-bit signal, respectively; each of the switch modules comprises n pieces of switch devices, wherein the k-th switch device turns on or turns off the connection between the k-th bit of the input end and the k-th bit of the output end corresponding to the switch device according to the input status of the operation end, wherein n is a positive integer number and $1 \leqq k \leqq n$.

12. The source driver as recited in claim 11, wherein the switch devices are MOSFETs.

13. The source driver as recited in claim 9, wherein the first status is logic high-level, while the second status is logic low-level.

14. The source driver as recited in claim 9, wherein the first status is logic low-level, while the second status is logic high-level.

15. The source driver as recited in claim 9, further comprising:

a shift register, coupled to the input end of the line latch.

16. The source driver as recited in claim 9, further comprising:

a level shifter, coupled between the line latch and the switching unit.

17. The source driver as recited in claim 9, further comprising:

a level shifter, coupled between the switching unit and the digital-to-analog converter (DAC).

18. The source driver as recited in claim 9, further comprising:

an output buffer, coupled to the output end of the digital-to-analog converter (DAC).

* * * * *